US011439241B2

(12) United States Patent
Bornstein

(10) Patent No.: US 11,439,241 B2
(45) Date of Patent: Sep. 13, 2022

(54) CHAIR HAVING A CLEANING IMPLEMENT INTEGRATED THEREON

(71) Applicant: Julia Bornstein, Muttontown, NY (US)

(72) Inventor: Julia Bornstein, Muttontown, NY (US)

( * ) Notice: Subject to any disclaimer, the term of this patent is extended or adjusted under 35 U.S.C. 154(b) by 0 days.

(21) Appl. No.: 17/159,926

(22) Filed: Jan. 27, 2021

(65) Prior Publication Data

US 2022/0232983 A1 Jul. 28, 2022

(51) Int. Cl.

| | |
|---|---|
| ***A47C 1/14*** | (2006.01) |
| ***A47K 7/02*** | (2006.01) |
| ***A47L 23/16*** | (2006.01) |
| ***A47C 7/62*** | (2006.01) |
| ***A47L 23/00*** | (2006.01) |

(52) U.S. Cl.

CPC ..... *A47C 7/62* (2013.01); *A47C 1/14* (2013.01); *A47K 7/026* (2013.01); *A47L 23/00* (2013.01)

(58) Field of Classification Search

CPC .. A47C 1/14; A47C 7/62; A47K 7/026; A46B 15/0075; A47L 23/16; A47L 23/00

See application file for complete search history.

(56) References Cited

U.S. PATENT DOCUMENTS

| | | | | |
|---|---|---|---|---|
| 1,475,298 | A * | 11/1923 | Guglielmello | A47L 23/02 15/97.2 |
| 2,060,384 | A * | 11/1936 | Shearer | A47L 23/02 15/35 |
| 3,131,967 | A * | 5/1964 | Spaulding | A47C 1/04 297/180.14 |
| 4,317,519 | A * | 3/1982 | Talley | A47C 4/52 206/223 |
| 5,301,457 | A | 4/1994 | Seely | |
| 6,131,925 | A | 10/2000 | Weldon | |
| 7,725,974 | B2 * | 6/2010 | Hughes | A47L 23/02 15/30 |
| 8,015,654 | B2 * | 9/2011 | Faiola | A46B 17/02 15/160 |
| 10,631,651 | B1 * | 4/2020 | Hsu Besner | A47C 4/46 |
| 2014/0230173 | A1 * | 8/2014 | DiNunzio | A47K 7/026 15/246 |
| 2021/0045617 | A1 * | 2/2021 | VanDeHey | A47L 23/00 |
| 2021/0346235 | A1 * | 11/2021 | Devanaboyina | A61H 23/006 |

* cited by examiner

*Primary Examiner* — Timothy J Brindley

(74) *Attorney, Agent, or Firm* — Greenberg Traurig, LLP; Scott Goncher

(57) ABSTRACT

Chairs having a cleaning system integrated thereon are provided. These chairs allow a user to comfortably clean their feet while in a sitting or reclined position.

2 Claims, 4 Drawing Sheets

CHAIR HAVING A CLEANING IMPLEMENT INTEGRATED THEREON

FIELD OF DISCLOSURE

The present disclosure is related to chairs comprising a cleaning implement. In particular, these chairs are configured to allow a user to be seated therein and use the cleaning implement while being seated.

BACKGROUND

Feet get dirty. Often a person's foot will become covered with particulate material such as sand, dirt, and mud which collects on feet after walking in an exterior locale. For example, when walking on a beach, feet may become covered with sand. Furthermore, as beach water dries the sand may form a dried coating on the feet which is difficult to remove.

It is desirable to remove this material. Specifically, a person with dirty feet will want to remove the foreign material before entering another location. Using the beach as an example, a person with dirty feet will often want to remove the dried coating of sand before entering their automobile, home, or pool. However, cleaning feet may be a difficult requiring someone with dirty feet to stand in an uncomfortable position as they remove the particulate matter or to stand on a painful surface such as hot concrete as they clean their feet. Moreover, infirmities and physical incapacities such as those caused by old age make these positions even more uncomfortable as the feet become difficult to reach and therefore hard to clean.

SUMMARY

In accordance with the foregoing objectives and others, the present disclosure provides chairs having an integrated cleaning system adapted to clean a user's feet. For example, the chairs may be used to clean sand or dirt which has accumulated on a user's feat. In most embodiments, the chairs are adapted for outdoor use, allowing for a user to position the chair where dirty feet often carry material into a location where such particulate material is undesired. In some embodiments, the chairs are lightweight and/or foldable, therefore allowing a user to transport the chair to a location such as a beach, pool, lake, forest, or campground.

The chairs of the present disclosure may have a seat and a frame able to support a user; wherein the chair comprises a cleaning system configured to clean one or both feet of the user when the user is supported in the chair; and wherein the cleaning system is configured to clean the feet and is supported by the frame. Typically, the frame comprises one or more legs such that the user is supported in a sitting position; wherein at least a portion of the cleaning system is attached (e.g., removably attached) to the one or more legs of the chair.

Apparatuses are also provided for cleaning feet which may comprise a chair having a seat and a frame able to support a user; wherein the chair is removably connected to a cleaning system configured to clean one or both feet of the user when the user is supported in the chair. For example, the cleaning system may comprise a fluid pump in fluid communication with one or more nozzles which, when connected to the chair, are oriented towards the feet of the user such that fluid pumped through the nozzles is able to clean the feet. In certain implementations, the one or more nozzles are connected to the fluid pump through a hose; and the hose is connected to the chair.

Cleaning systems are also provided for cleaning feet, which may comprise one or more points of attachments configured to be attached to a chair, such that when attached to the chair, said cleaning system is able to clean one or both feet of the user when the user is supported in the chair. The chair may provide the support to orient the cleaning system in a manner suitable for cleaning the feet. For example, the cleaning system may comprise one or more portions that may be dimensioned to match and be connected to one or more portions of a chair such as the back of the chair, under the seat of the chair, to one or more (e.g., two, three, four) legs of the chair, or combinations thereof. In certain embodiments, the cleaning system comprises one or more clamps dimensioned to attach to the leg of a chair. For example, the cleaning system may comprise a hose to provide a fluid connection between a fluid pump and a nozzle, wherein the hose may comprise one or more connection points to attach the hose to one or more legs of the chair and orient the nozzle towards a user's feet. In various implementations, one or more portions of the cleaning system (e.g., such as the fluid pump) may be placed proximal to the chair during operation of the cleaning system.

The cleaning system may take many forms capable of cleaning the feet. For example, the cleaning system may comprise a brush such that a user is able to rub their feet against the brush, while sitting in the chair, thereby removing particulate material that may have accumulated on the feet. In certain embodiments, the brush may be attached to one of the one or more legs of the chair. The brush may be attached to one of the one or more legs via a swivel (e.g., a coupling between the brush and leg allowing one to rotate without turning the other); wherein the brush can be rotated into a cleaning position allowing the user to clean one or both feet, and the brush can be rotated into a storage position. In various aspects, the frame may comprise two or more legs, wherein at least one of the legs is oriented proximal to one leg of the user when the user is supported in the chair, another of the support legs is oriented proximal to the other leg of the user when the user is supported in the chair; and wherein the chair comprises one brush on each support leg proximal to the user's leg. In certain embodiments, at least one of the legs is oriented proximal to one leg of the user when the user is supported in the chair, another of the legs is oriented proximal to the other leg of the user when the user is supported in the chair; and the chair comprises one brush on each support leg proximal to the user's leg. Each brush may be attached to a leg via a swivel; wherein each brush can be independently rotated into a cleaning position allowing the user to clean the feet of the leg proximal to the support leg, and each brush can be independently rotated into a storage position. Likewise, a single brush could be used to clean both feet simultaneously. The brush may take any form in order to aid in cleaning the foot. For example, the brush may be cylindrical comprising a plurality of bristles on its surface.

The cleaning system may also comprise a fluid pump or blower such as an air blower or a water pump. For example, the air blower may be configured to blow air at the feet of the user positioned in the chair, such that the particulate material may be removed from the feet. In some embodiments, the cleaning system such as the blower is positioned beneath the seat support of the chair. In various implementations, the blower may be supported by the frame and the seat. In some embodiments, one or more portions of the cleaning system is attached to the legs of the chair.

The fluid (e.g., air and/or water) pump and/or blower may be in fluid communication with one or more nozzles oriented towards the feet of the user when the user is positioned in the chair. Fluid may be expelled through the one or more nozzles with a force such that the particulate material is removed from the feet. In certain implementations, the nozzle may be moveable. Moveable nozzles may allow for the fluid to be sprayed to an area proximal of the chair, such as the ground next to the chair in order to clean the feet or provide comfort to another user situated near the chair. In certain embodiments the cleaning system comprises one or more nozzles in fluid communication with the blower and/or dryer oriented at a location other than the user's feet such as an area proximal to the chair.

The fluid connection between the nozzle and the pump and/or dryer may comprise a hose such a flexible hose composed of plastic including polypropylene. A portion of the hose may be connected to the frame. The fluid pump may comprise a fluid reservoir attached to the frame of the chair as well. The fluid reservoir may provide a reservoir of fluid (e.g., water) in fluid communication with the fluid pump such that the fluid may be taken from the reservoir and moved through the nozzle openings. In certain implementations, the fluid for the fluid pump may be provided via a hose connected to the fluid pump and in fluid communication with a source of the fluid. For example, the water may be provided to the cleaning system from another source such as a pool, or the ocean, or a bucket filled with water. In some embodiments, the fluid reservoir may be removably attached to the back of the chair. In some embodiments, the fluid reservoir may be removably attached beneath the seat of the chair.

DETAILED DESCRIPTION

Detailed embodiments of the present disclosure are disclosed herein; however, it is to be understood that the disclosed embodiments are merely illustrative of the disclosure that may be embodied in various forms. In addition, each of the examples given in connection with the various embodiments of the disclosure is intended to be illustrative, and not restrictive.

All terms used herein are intended to have their ordinary meaning in the art unless otherwise provided. All concentrations are in terms of percentage by weight of the specified component relative to the entire weight of the topical composition, unless otherwise defined.

As used herein, "a" or "an" shall mean one or more. As used herein when used in conjunction with the word "comprising," the words "a" or "an" mean one or more than one. As used herein "another" means at least a second or more.

Figure 1:
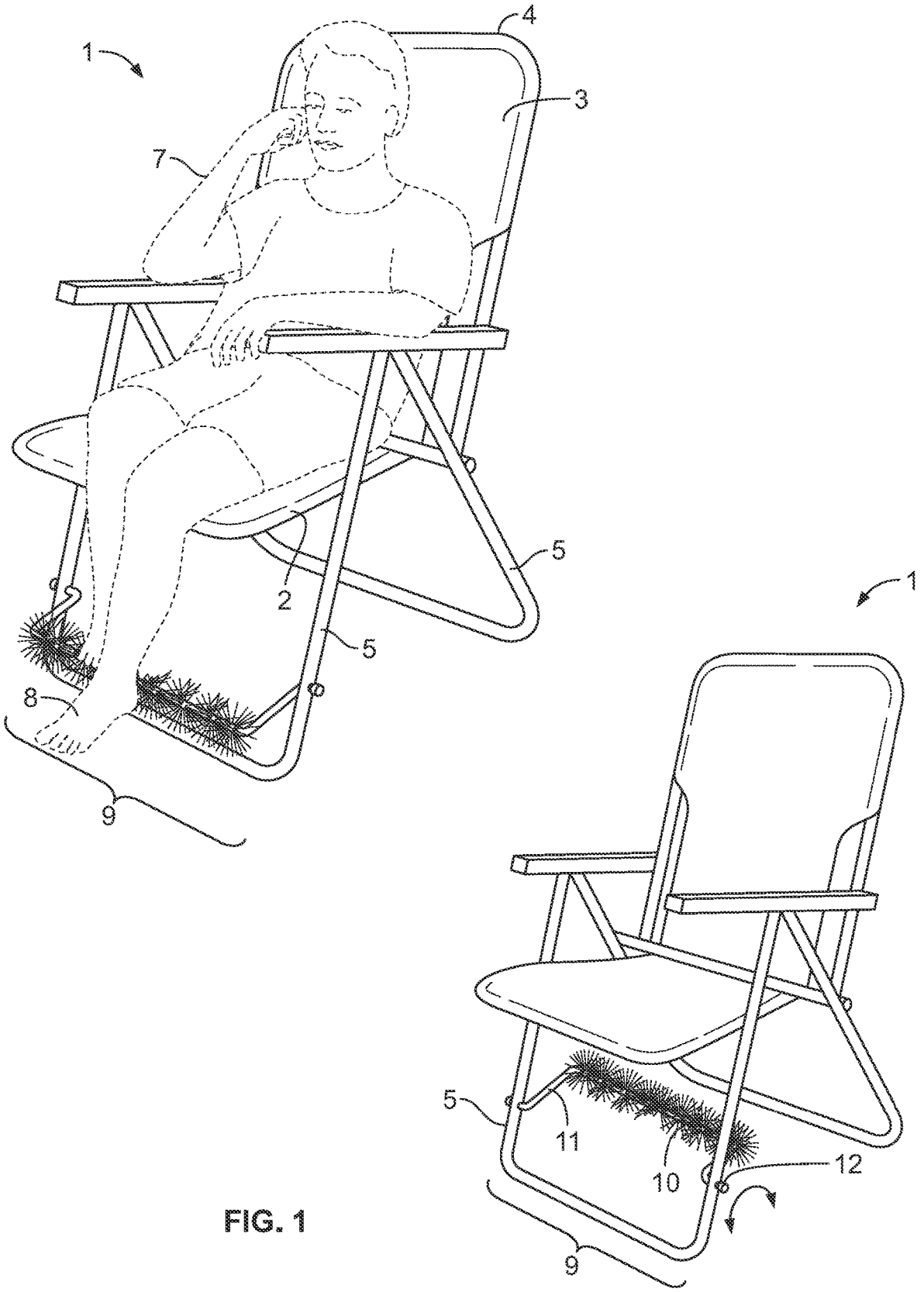
FIG. 1 illustrates a perspective view of a user positioned in a chair having a brush cleaning system (top left image), and the chair same chair without the user (bottom right image).

Referring now to FIG. 1, a chair 1 having seat 2, back 3, and frame 4 is illustrated. Frame 4 supports the chair in part through legs 5 such that user 7 is able to sit therein. Chair 1 comprises a cleaning system 9 positioned at the area where the feet of user 7 sit. Cleaning system 9 is a brush which may be substantially cylindrical having a plurality of bristles extending in one or more directions. In some embodiments, the plurality of bristles may be located on one or more substantially planar surfaces and extend therefrom. Cleaning system 9 is attached to the frame 4 at the legs 5 with a cleaning support bar 11 extending across two legs of the frame 4. On cleaning support bar 11 is a cleaning implement 10 which user 7 may use to clean feet 8 such as to remove particulate material that has been deposited thereon. The cleaning support bar 11 may be attached to the frame with one or more swivels 12 allowing the cleaning system to be positioned out of the way of the user when not in use (e.g. underneath seat 2 as depicted). In the embodiment depicted, two swivels 12 are used allowing for a circular rotation of the cleaning system with respect to the length dimension of the chair. In some embodiments, the cleaning system may rotate with respect to the length, height and/or width dimensions of the chair, or combinations thereof.

The chair may include a suitable support in order to accommodate an occupant. These supports may be composed of, for example, a fabric such as canvas, mesh, plastic, wood, metal, or combinations thereof. Such support may be located on the seat and/or the back of the chair. In some embodiments, the supports are positioned to allow the occupant to sit in an upright position. In some embodiments, the supports may be positioned to allow for the user to sit in a reclined position or with the legs extended (e.g., in a chaise lounge configuration). Any support may be contoured in a manner such that the user may comfortably rest on the chair. It will be understood that the chairs of the present disclosure may have many different configurations such as chaise lounge, folding chair, reclining chair, rocking chair, or adirondack chair. In some embodiments, the chair is lightweight and foldable. The cleaning system may be configured in order to provide cleaning to an occupant sitting or lying in the chair in a typical position (e.g., as illustrated in FIG. 1).

Figure 2:
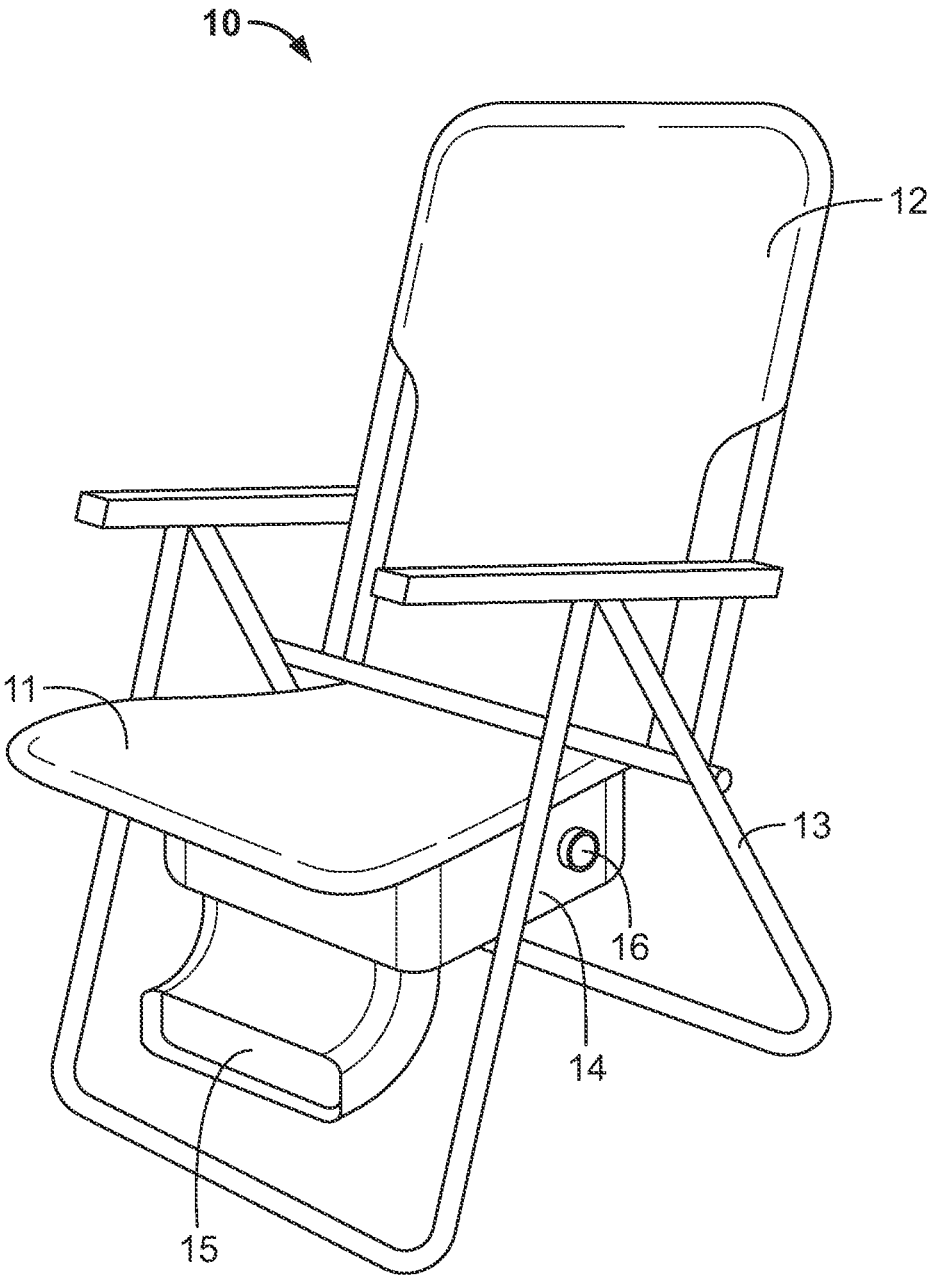
FIG. 2 is a perspective view of a chair of the disclosure having an air blower cleaning system.

Referring now to FIG. 2, chair 10 is depicted having seat 11, back 12, and frame 13. The cleaning system comprises an air blower 14 with orifice 15 oriented towards the portion of chair 10 where a user typically puts their feet. The air blower 14 propels air through orifice 15 towards a user's feet. Air blower 14 may operate with, for example, a compressor or a fan operating within the housing to force the air through orifice 15. The rate and volume of airflow may be controlled with controller 16 which, in the embodiment depicted, is situated proximal to where a user may control air blower 14 while sitting. In some embodiments, controller 16 may be a binary switch (i.e., an on/off switch) or a dial allowing for control of the airflow. In certain implementations, the blower may be powered by an internally stored battery, a connection to a battery, or a connection to an electrical outlet (e.g., AC wall outlet).

Figure 3A:
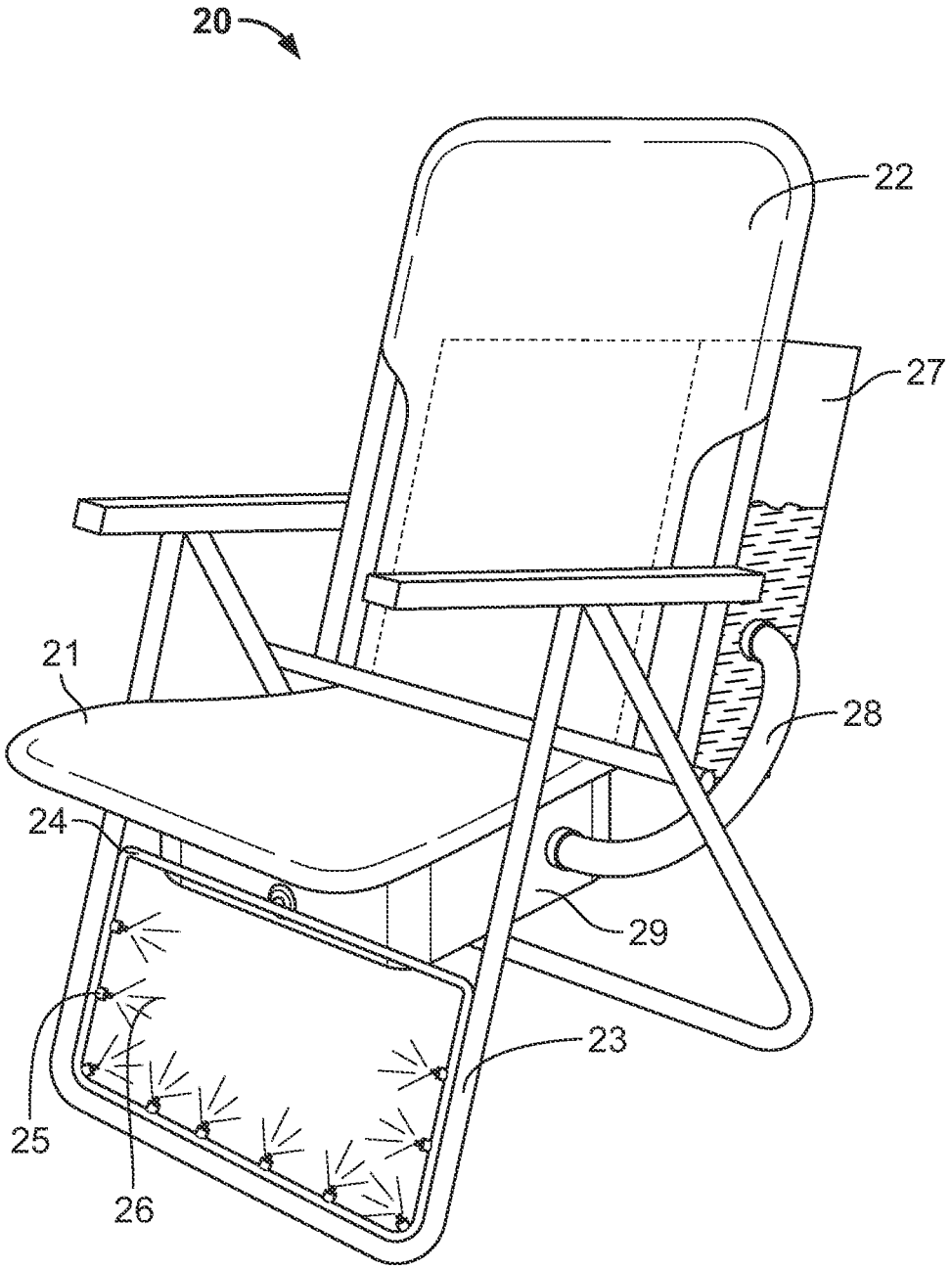
FIG. 3A is a perspective view of a chair of the disclosure having a fluid pump (e.g., water) cleaning system where fluid is pumped out of one or more nozzles.

Referring now to FIG. 3A, chair 20 is depicted having another fluid pump (e.g., air and/or water) 29 positioned underneath seat 21. The fluid pump is in fluid communication to one or more nozzles 25 through hose 24. When the pump is activated, fluid (water in the embodiment depicted), is forced through the nozzle to be sprayed at a user's feet near the leg portion of frame 23 with spray 26. In the embodiment depicted, the hose is oriented in a rectangular configuration attached to both front legs 33 thereby allowing for fluid to clean the feet from the bottom and both left and right sides. In some embodiments, hose 24 may further comprise one or more nozzles oriented at the top such that the top of the foot may be cleaned as well. In certain implementations, the hose may comprise a single nozzle and one or more points of attachment to the frame such that the nozzle may be oriented to provide a spray in any direction. In some embodiments, the cleaning system may be oriented towards an area proximal to the chair. For example, the cleaning system may be oriented to spray fluid (e.g., water) towards an object or subject sitting or lying next to the chair. A user may move their feet through one or more of the sprays formed from the cleaning system in order to use the system. Additionally, chair 20 comprises a water reservoir 27 which is positioned on the back side of chair back 22. The water tank 27 is in fluid communication with pump 29 through hose 28. Water from reservoir 27 may be refilled in order to supply more fluid as necessary. In certain embodiments, the water reservoir is removably attached from the chair back and/or the connection hose.

Figure 3B:
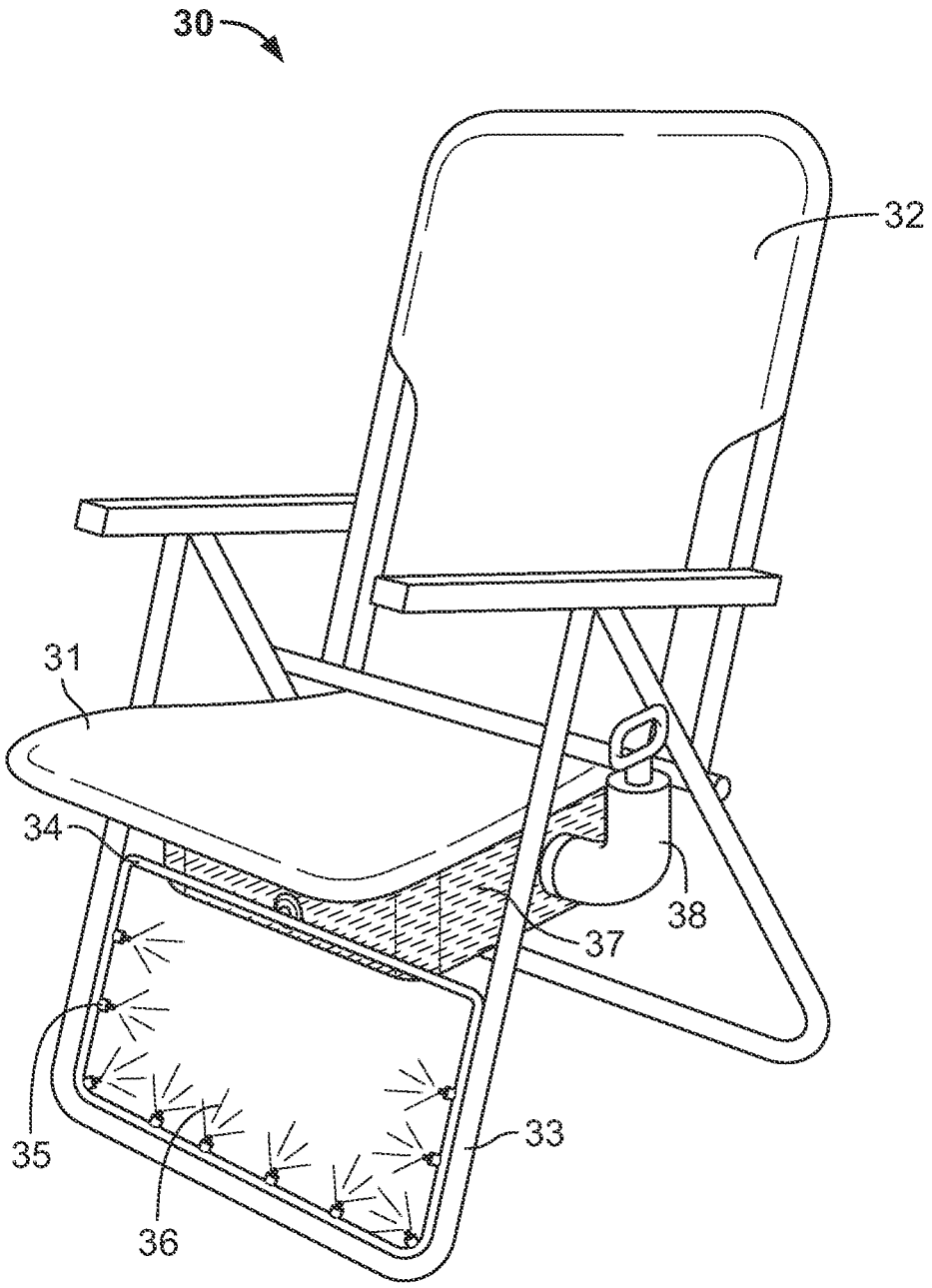
FIG. 3B illustrates another fluid pump cleaning system involving a hand pump for pumping the fluid out of the nozzles.

FIG. 3B illustrates chair 30 having seat 31 and back 32. The cleaning system comprises a fluid reservoir 37 oriented underneath seat 31. Nozzles 35 are in fluid communication with reservoir 37 via hose 34. Attached to reservoir 37 is a hand pump 38 which may be pumped by user to provide the required force to propel fluid (e.g., water, air) through hose 34 towards nozzle 35 to result in spray 36.

As various changes can be made in the above-described subject matter without departing from the scope and spirit of the present disclosure, it is intended that all subject matter contained in the above description, or defined in the appended claims, be interpreted as descriptive and illustrative of the present disclosure. Many modifications and variations of the present disclosure are possible in light of the above teachings. Accordingly, the present description is intended to embrace all such alternatives, modifications and variances which fall within the scope of the appended claims.

The invention claimed is:

1. A chair having a seat and a frame able to support a user; wherein the chair comprises a cleaning system configured to clean one or both feet of the user when the user is supported in the chair, and the frame comprises more than two legs;

wherein the cleaning system comprises a brush attached to two legs of the chair, and the brush is attached to two legs of the chair with a swivel at each leg allowing for circular rotation of the cleaning system; and wherein the brush can be rotated into a cleaning position allowing the user to clean one or both feet, and the brush can be rotated into a storage position.

2. The chair according to claim 1, wherein said brush is substantially cylindrical comprising a plurality of bristles on the surface of the brush.

* * * * *